US006015165A

United States Patent [19]

Artemis et al.

[11] Patent Number: 6,015,165

[45] Date of Patent: Jan. 18, 2000

[54] WEIGHT DISPERSION AND SUPPORT DEVICE

[76] Inventors: Chris A. Artemis, 16359 W. 10th Ave. #W4; William P. Mentgen, 1185 Orchard St., both of Golden; Daniel A. Joseph, 9629 W. Chatfield Ave., Littleton, all of Colo. 80123

[21] Appl. No.: 08/889,413

[22] Filed: Jul. 8, 1997

[51] Int. Cl.[7] ..... A63C 11/24

[52] U.S. Cl. ..... 280/824; 135/84; 441/59

[58] Field of Search ..... 280/824, 809, 280/823, 819; 441/59, 60; 135/77, 80, 84, 72, 65

[56] References Cited

U.S. PATENT DOCUMENTS

| | | | |
|---|---|---|---|
| 999,821 | 8/1911 | Massey | 441/60 |
| 1,522,526 | 1/1925 | Kuhn | 441/60 |
| 1,545,807 | 7/1925 | Ajello | 441/60 |
| 1,621,255 | 3/1927 | Hunter | 135/84 |
| 1,779,590 | 10/1930 | Eilers | 441/60 |
| 2,492,916 | 12/1949 | Chute et al. | 135/53 |
| 2,893,021 | 7/1959 | Lundborg | 441/59 |
| 3,163,437 | 12/1964 | Phillipson . | |
| 3,743,311 | 7/1973 | Giambazi . | |
| 3,858,900 | 1/1975 | Quinn . | |
| 4,014,559 | 3/1977 | Funke . | |
| 4,040,136 | 8/1977 | Garcia | 441/59 |
| 4,091,828 | 5/1978 | Jorgensen | 135/66 |
| 4,093,250 | 6/1978 | Wilkstrand . | |
| 4,669,752 | 6/1987 | Jackson et al. . | |
| 5,392,801 | 2/1995 | Hannoosh et al. | 135/65 |

*Primary Examiner*—Lanna Mai
*Assistant Examiner*—Bridget Avery
*Attorney, Agent, or Firm*—Stachniak & Stachniak; Jennifer S. Stachniak

[57] ABSTRACT

A weight distribution and support device for use on an unstable support surface includes attachment means for engagement with the lower end of a ski pole and a support base, or umbrella, adapted to be opened and closed. The support sturcture has a plurality of support spines radially extending from the attachment means, and a covering which surrounds and is supported by the spines. When in its opened state, the support base or umbrella engages the surface of the snow, thereby allowing the user to lean upon the upper end of the ski pole, exerting a downward force upon the support base, and gaining stability when standing up in deep snow or other unstable conditions. The support device preferably includes a strap or other means secured to the outer covering to maintain the device in its closed state during transport and storage, or to allow the user to wear the device on his hand, without the need for a ski pole. The device may also be used as a support stand for equipment in sand or snow.

14 Claims, 9 Drawing Sheets

FIG.5
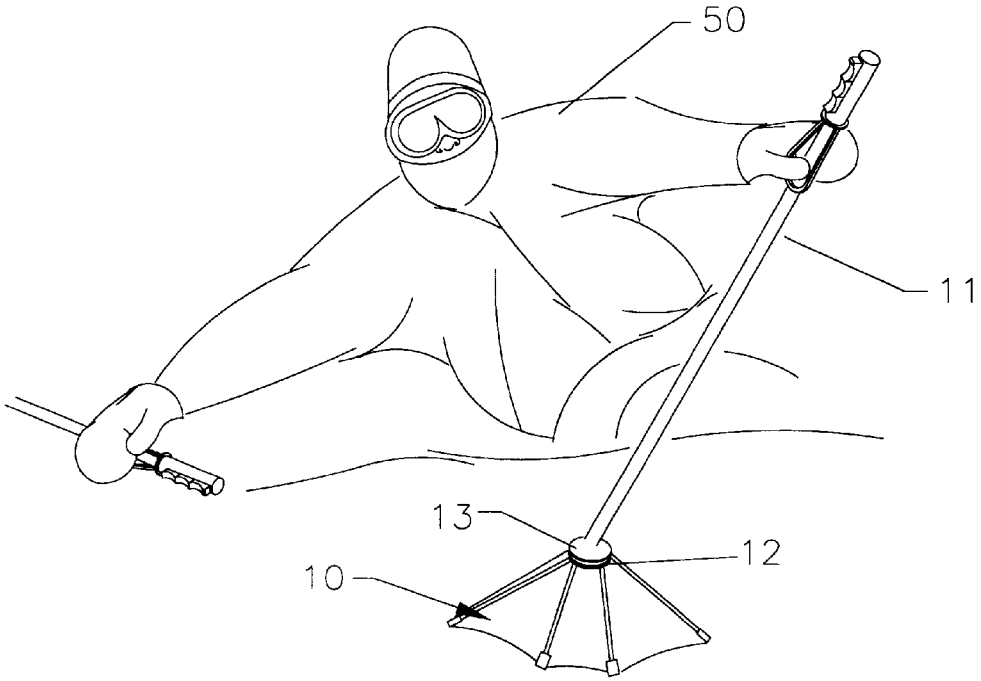
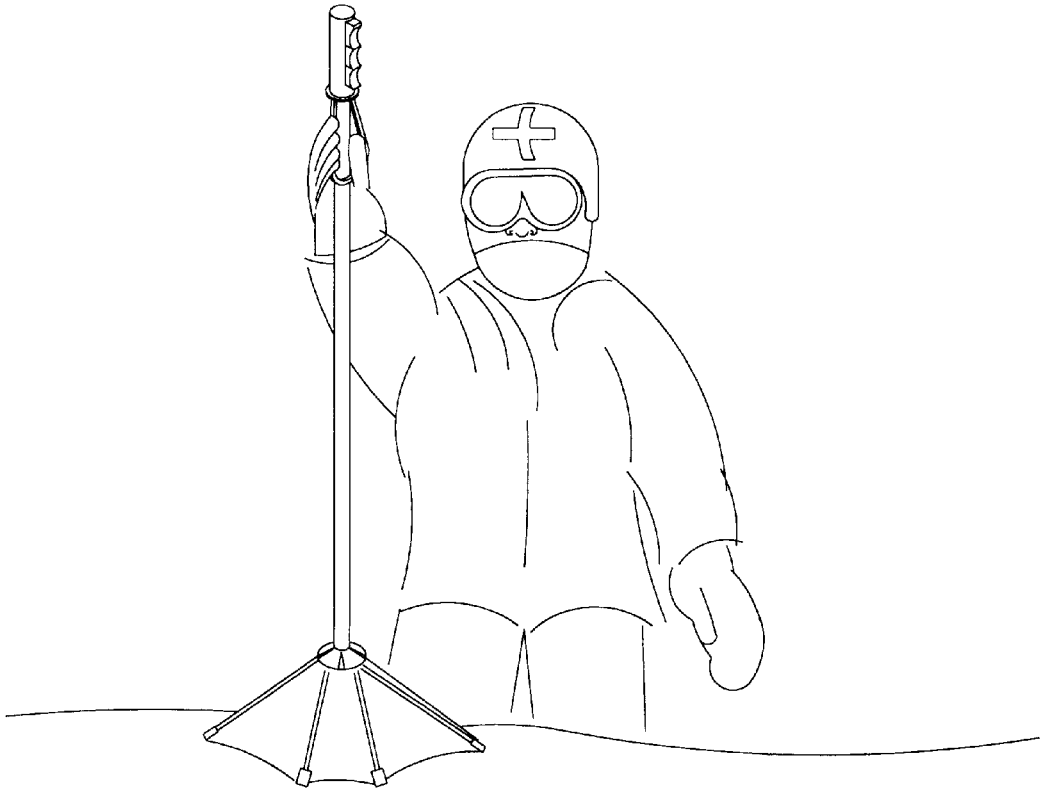
FIG.6

FIG.7
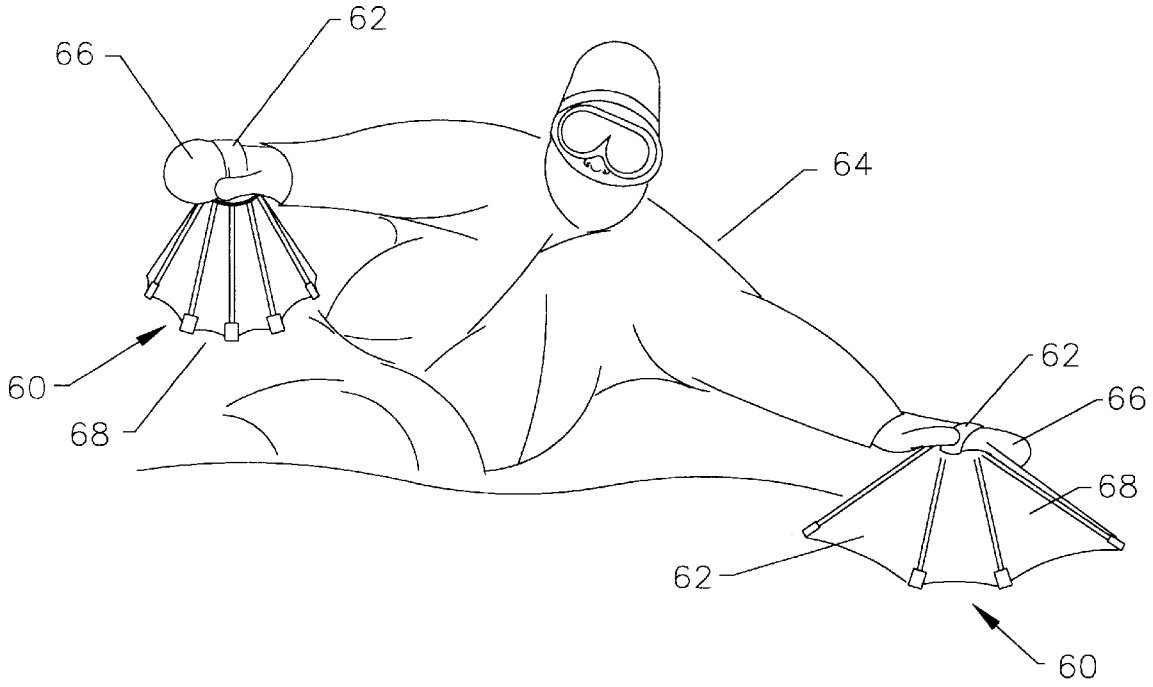
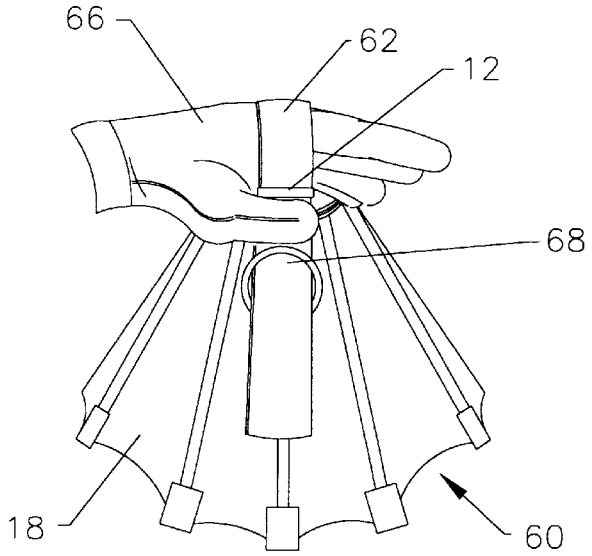
FIG.8

WEIGHT DISPERSION AND SUPPORT DEVICE

BACKGROUND

1. Field of the Invention

The present invention relates generally to equipment used to lend stability in deep snow or sand, and more particularly, relates to a collapsible, readily transportable attachment device for use with ski poles and other equipment to better support and disperse a user's weight in deep snow or to better maintain stability of equipment, such as a gun stand or mount, in deep snow or sand.

2. Description of Related Art

Skiers, snowboarders, snowshoers and other backcountry sports enthusiasts are frequently confronted with difficult terrain and weather conditions, including extremely deep snow or powder, which make maintaining one's balance or standing up after a spill quite difficult. Typically, losing one's balance in deep pockets of snow requires a great deal of time and expenditures of energy to stand up because the surface tension of the softer powder-like snow does not provide the athlete with a solid surface on which to push up.

The typical downhill or cross-country skier uses a pair of ski poles to help maintain his balance and to provide assistance in standing up after a fall by embedding one end of the pole into the snow and then leaning on the upper end of the pole as a lever-type support while standing. The standard ski pole includes a generally circular cup, or basket, as it is commonly known, proximate its lower end, the ski pole tip extending several inches beyond the basket. The basket is intended to provide a bit more stability and balance to the user by engaging the snow on its lower surface, and also preventing the ski pole from slipping into and being lost in deeper snow. Typically, however, the basket is only several inches in diameter and provides only minimal support in deep powdery snow. More often, the basket will also slip through the surface of the snow cover and allow the remainder of the ski pole to slide into the snow when the user puts any undue amount of force or weight, such as his or her body weight, upon the upper end of the pole.

Snowboarders and snowshoers generally do not use any type of pole or other balance device, but can experience the same difficulties when maneuvering or traversing deep snow when they lose their balance and end up floundering around in the snow for lengths of time in efforts to stand up.

On a more serious note, it is possible for a winter athlete to end up in depths of snow that can be life threatening, for instance, if the athlete struggles to the point of exhaustion or manages by unsuccessful attempts to free himself to bury himself even further.

Attempts have been made in the prior art to provide devices for use with ski poles that basically replace the standard basket and provide additional surface contact area and thus, more stability and support to a skier in deep snow or other unstable conditions. For example, U.S. Pat. No. 4,700,975 to Ehemann et al shows a ski pole road and snow support element attached to the lower end of the ski pole rod. The snow support element has a downwardly open shell element with a deflecting collar and a rim for contacting a snow surface and preventing slippage of the pole with respect to the snow surface. Similarly, Wilkrand in U.S. Pat. No. 4,093,250 describes a ski pole which lacks a central spike member, and instead, terminates in a spherically shaped cap-like member for forming a cushion of compressed snow. The cap-like member is intended to act as a fulcrum and bearing point for the ski pole, and includes a cowl on the upper side of the show for preventing the collection of snow. The show includes downwardly projecting teeth around its periphery. U.S. Pat. No. 4,014,559 to Funke discloses a ski pole assembly having a snow engaging disc at one end of the pole which is biased toward a rest position by a resilient tubular mounting member. The snow engaging member covers the free end of the pole in its rest position only. U.S. Pat. Nos. 4,669,752 to Jackson et al., 3,743,311 to Giambaiz, 3,858,900 to Quinn, and 3,163,437 to Phillipson also show various types of ski pole baskets.

While the above-described art has attempted to resolve the problems associated with skiing in deep snow, the above devices fail to provide much improvement over the standard basket typically found on both downhill and cross-country type ski poles. More specifically, the above-described apparatus do not suggest that the user could apply a great deal of force upon the pole, and thus upon the basket or support members, without the basket sinking into the snow or even buckling in upon itself. Further, the above patents do not suggest an attachment that can be readily flattened, or collapsed upon itself, to allow the user to easily transport and store the device until it is needed in deeper snow. Rather, most of the above devices show the basket in place for use at all times on the pole, no matter what the conditions, and even that the ski pole must be specially designed or equipped to fit the attachments.

Finally, none of the related art shows or suggests a device that can be used by snowboarders, snowshoers, or winter hikers without a ski pole, rather, worn on the hand.

SUMMARY OF THE INVENTION

The present invention resolves the disadvantages associated with standard ski poles and the above related art. Specifically, the present invention may be easily and readily attached to any type of standard ski pole used in either downhill or cross-country skiing without the use of special adaptations to the pole.

In addition, the present invention features a unique umbrella-like construction which allows it to be collapsed inwardly for storage in a pocket, pouch or fanny-pack when not needed and then readily popped back into an erect state for use. The structure of the present invention allows a user to apply a quite substantial downward force upon the device, such as the user's body weight, and the device will maintain its conformation upon the snow's surface. The device's hexagonal engagement with the snow's surface distributes the force over a larger area on the snow's surface than that covered by standard pole baskets and the above related art devices, thus providing more stability and support to the user when standing or otherwise attempting to main balance.

A further embodiment of the present invention may be used without a pole of any kind, by inclusion of a strap or other attachment means that will allow the device to be hand-held by a snowboarder or winter hiker, for instance, when navigating deep snow. Another embodiment of the present invention contemplates using a larger version of the support device in other unstable terrain, such as sand, as a support stand or mount for equipment, such as guns or telescopes, for instance. The surface-contacting area of the device would be expanded in this case to support heavier equipment and provide additional stability in slippery and unstable sandy terrain.

In accordance with the present invention, a weight distribution and support device broadly comprises an attachment means for engagement with the lower end of a ski pole and a support structure, or umbrella.

The support structure comprises a plurality of support spines or fingers radially extending from the attachment means, and a flexible, preferably waterproof covering which surrounds and is supported by the spines. When in its expanded state, the base of the support structure or umbrella which engages the surface of the snow or other unstable material displays a hexagonal or substantially circular configuration, depending upon the number of support spines used. The base of the support structure umbrella includes a resilient, flexible wire or cord threaded around the peripheral edge of the cover, thereby providing tension around the lower edge of the umbrella for easy release and closure of the umbrella for use and storage, as well as increased stability when the structure is placed on snow or other surface. The support device preferably includes a strap or other means secured to the outer covering to maintain the device in its closed state during transport and storage.

The attachment means comprises upper and lower sections, the upper section preferably circular in configuration and containing a plurality of bores therethrough, including a center bore through which the ski pole tip is inserted. Bores arranged about the circumference of the upper section are adapted to pivotally engage the upper ends of the support spines. The attachment means' lower section includes a circular plate which is secured to the underside of the upper section of the attachment means, and which extends downwardly into a conical chamber for retention of the ski pole tip in place within the cone. The attachment means is adapted to accommodate all types of ski poles, whether cross-country or downhill, by engagement at the pole's lower end, below the pole's basket, without the use of special adaptors or additional equipment to adjust the device to fit different sized poles.

In use, the support device is simply attached to a ski pole by insertion of the pole tip through a bore in the attachment means. A strap used to secure the device in a closed, stored state is released and the device may be expanded for use, much like opening up an umbrella. The skier may then use the pole with the attached device to push up of the snow when standing up, or to otherwise help maintain balance.

The present invention is also contemplated for use by the ski patrol, a skiing safety patrol. One aspect of the ski patrol's job is to regularly test cornices and other unstable areas for very deep and loose snow. The patrol also manually foot-packs areas of deep, looser snow by side-stepping up the areas while wearing their skis to better stabilize the snow and prevent accidents or avalanche. The present invention is ideally suited for use by the ski patrol in these sometimes dangerous tasks by providing a balancing and supporting device in these conditions.

Another embodiment of the support device contemplates use by snowboarders, snowshoers, hikers, or others who travel or play in unstable terrain without using poles. In this instance, the upper surface of the attachment means may include a strap traversing its diameter and secured to peripheral edges of the attachment means, thereby allowing the user to slip his hand through the strap and use the device by applying force downwardly from the palm of the hand when in difficult terrain. Preferably, if intended only for use by the hand, the attachment means, and support umbrella, would necessarily have to be of a larger diameter to allow proper securement of the hand strap to the device and adequate space for the user's hand through the strap and device.

A third embodiment of the present invention contemplate use of a slightly larger version of the support device as a support stand for equipment, such as guns or telescopes. In this instance, the attachment means includes a threaded cone for mated engagement with the lower end of an equipment stand, onto which the gun or telescope is mounted. The device thus allows stable placement of such equipment on sand, snow or other unstable terrain when the device is in its expanded state.

Other objects, features, and advantages of the present invention will become more fully apparent from the following detailed description of a preferred embodiment, the appended claims, and with reference to the accompanying drawings forming a part of the specification.

BRIEF DESCRIPTION OF THE DRAWINGS

FIG. 5 is a perspective view of the present invention in use on a ski pole, assisting a skier in standing up in deep snow;

FIG. 6 is a perspective view of the present invention in use on a ski pole, assisting the user in waling through deep snow;

FIG. 7 illustrates a second embodiment of the present invention which includes a strap for use on the hand;

FIG. 8 illustrates the second embodiment of the present invention in use on both hands of a snowboarder;

DETAILED DESCRIPTION OF THE PREFERRED EMBODIMENTS

Figure 1:
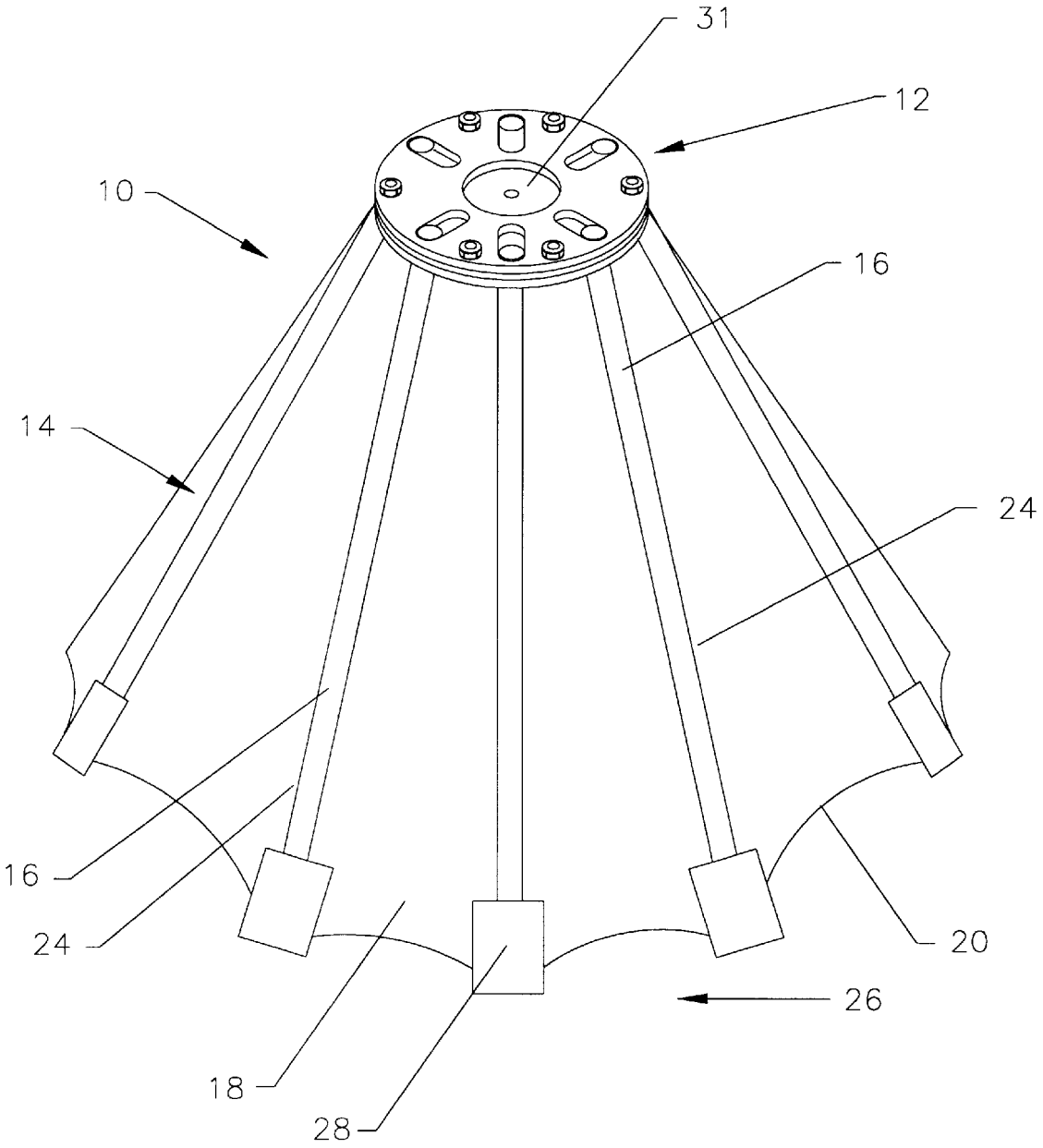
FIG. 1 is a perspective view of the weight dispersion and support device of the present invention in a semi-expanded state.
Figure 2:
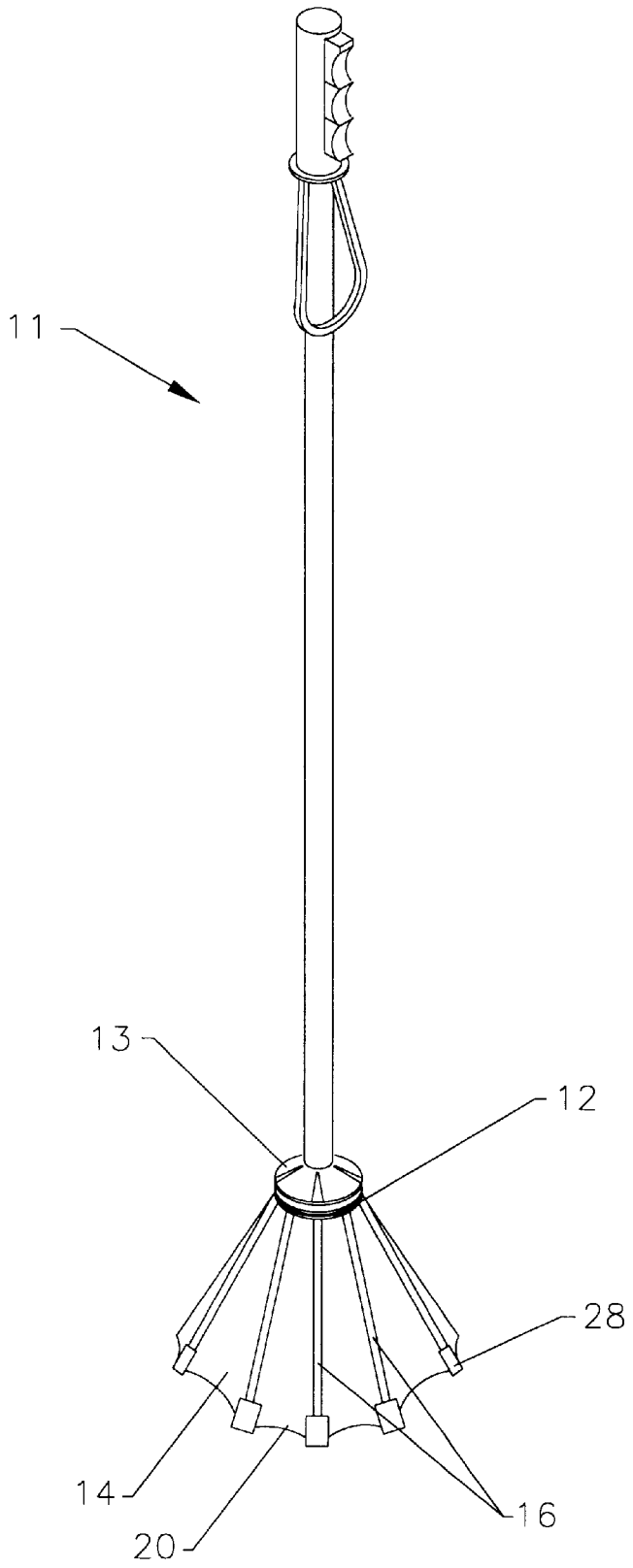
FIG. 2 is a perspective view of the support device attached for use to the lower end of a ski pole and in its expanded state.

Referring now to the drawings in more detail, and in particular to FIGS. 1 and 2, the weight dispersion and support device 10 broadly comprises an attachment means 12, for attachment to the lower end of a ski pole 11, and a support base or umbrella 14.

The support base or umbrella 14 comprises a plurality of support spines 16 pivotally engaged and downwardly extending from the attachment means 12, and an outer covering 18 substantially encasing and supported by the support spines 16. The outer covering 18, preferably made of a flexible, waterproof material such as nylon or Gortex, includes elongated pockets or channels 24 formed to encase each of the spines 16 so that the spines 16 are not exposed. The peripheral edge 20 of the support base 14, which engages the support surface 26, includes a flexible tension wire or cord 22 threaded through a channel in the cover 18 to provide increased tension when the peripheral edge 20 contacts the support surface 26, and also aids in quickly releasing the support base 14 from a closed state.

As best illustrated in FIGS. 1 and 2, depending upon the number of support spines 16 employed in the device 10, the lower edge 20 will form a generally oval or circular shape. The preferred form of the device 10 utilizes six support spines 16; the peripheral edge 20 of the base 14 will therefore form a generally hexagonal shape on the support surface 26. Preferably, the peripheral edge 20 will include a plurality of reinforcements 28 stitched about the lower ends of each support spine 16 to prevent the spines 14 from tearing through the outer covering 18.

In use, the umbrella-like support base 14 is in the opened state when the user, or skier, desires increased stability and support in deep snow or other unstable surfaces. The support spines 16 being pivotally engaged with the attachment means 12 are adapted to pivot outwardly, each of the spines 16 forming an obtuse angle with the attachment means 12, when the support base 14 is opened, the spines 16 and covering 18 forming a small and very sturdy umbrella on which the skier may support himself. When not in use, the attachment means 12 is simply released from the ski tip pole and the support base 14 collapsed, or closed, by pressing inwardly on the support spines 16, forcing them towards one another, much like closing an umbrella.

As best shown in FIG. 2, the lower end of a standard ski pole 11 is releasably engaged with an the attachment means 12, which will be described in greater detail with reference to FIGS. 3–6, such that the ski pole's tip (not shown) is inserted through a central bore 30 in the attachment means 12 and the ski pole's basket 13 contacts the attachment means 12.

Figure 3:
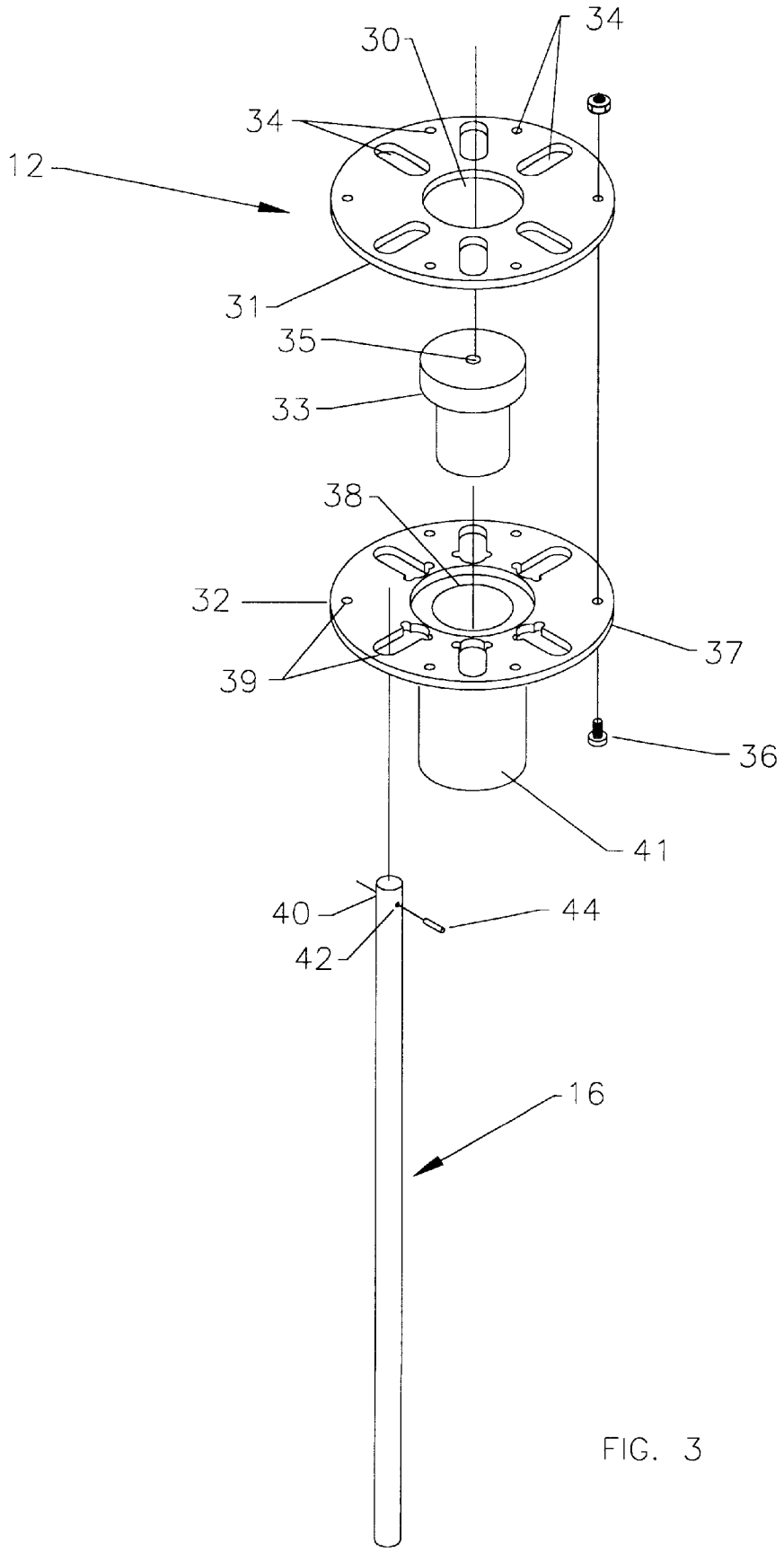
FIG. 3 is an exploded view of the attachment means, illustrating the engagement with the support spines.
Figure 4:
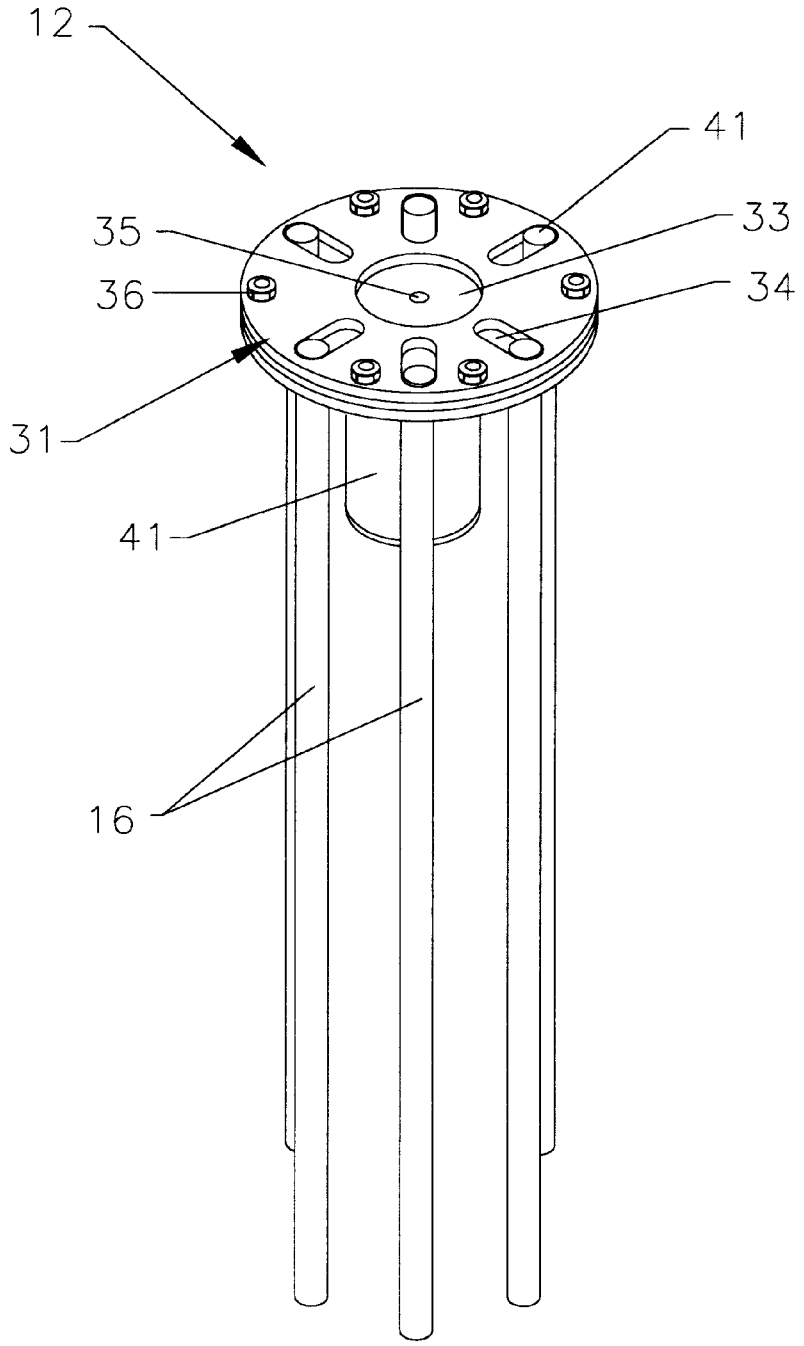
FIG. 4 is a perspective view of the attachment means with the support spines engaged therein, without the outer covering surrounding the spines.

FIGS. 3 and 4 best illustrate the structure of the attachment means 12 and its engagement with the support spines 16. Specifically, the attachment means 12 comprises an upper portion 31, a lower portion 32, and an intermediate portion 33. The upper portion 31 is preferably a circular diskette and made out of a lightweight plastic, although steel, aluminum or other a lightweight metal could also be used. The upper potion 31 includes a plurality of bores therethrough, including a central bore 30 and a number of peripheral bores 34 intended for engagement with the support spines 16 and to accommodate fasteners 36, which secure the upper and lower portions 31, 32 together.

The lower portion 32 is preferably made of a lightweight plastic or like material, although a lightweight metal could also be used, and includes a generally circular upper surface 37 for mated engagement with the upper portion 31 of the attachment means 12. A plurality of bores, including central bore 38 and peripheral bores 39, drilled through the upper surface 37 are arranged to align with the central bore 30 and peripheral bores 34 of the upper portion 32 when the upper portion 32 is placed on the upper surface 37.

As best shown in FIG. 3, the peripheral bores 39 include enlarged areas, adapted to receive the upper ends 40 of the spines 16. The support spines 16 are preferably elongated rods or cylinders and are made of a strong and durable plastic or similar material which can support at least 250 pounds of pressure, when used in the preferred arrangement. The upper end of each spine 16 includes a small opening 42, through which a pin 44 is threaded, such that the spine 16 may be inserted and attached to the lower portion 32 of the attachment means 12 into a respective peripheral bore 39. The pins 44 are adapted to fit into the enlarged areas of the peripheral bores 39, thereby allowing the spines 16 to pivot outwardly and inwardly when the support based 14 is opened and closed, respectively.

The lower portion 32 also includes a conical channel 41 integrally joined with the underside of upper surface 37 and extending downwardly therefrom. As noted above, the conical channel 41 is intended to receive and maintain in place the lower portion of the ski pole 11, the tip.

The intermediate portion 33, conformed as a disk-like structure with a small center opening 35 for placement between upper and lower portions 31, 32, is sized to fit within the central bore 38 in the lower portion 32 and to snugly engage the tip of the ski pole 11 through its central opening 35. Intermediate portion 33 is preferably made of a rubber-like material, such as C-1002, a vibration-dampening substance.

The portions 31, 32, 33 of the attachment means, when assembled together as above described, allow the attachment means 12 to accommodate the tips of all types of ski poles, whether cross country or downhill-type poles.

FIG. 4 illustrates the spines 16 in place through corresponding peripheral bores 34, 39 in the upper and lower potions 31, 32 respectively, when the device 10 is in a closed position.

FIGS. 5 and 6 show the device 10 attached to a ski pole 11 and in use by a skier 50 and rescue personnel 51, respectively. As FIG. 5 illustrates, the pole 11 is pivotable about the attachment means 12 to allow the skier 50 to apply an angled, downward force upon the device 10 and assist the skier 50 in standing from a fallen position in deep snow. FIG. 6 illustrates the device 10 used by a rescue worker to walk through deep snow, with the pole 11 oriented in a vertical position relative to the device 10, with a downward force applied directly to the device 10.

Another embodiment of the present invention is illustrated in FIGS. 7 and 8. In this configuration, the device 60 includes an adjustable, sturdy strap 62 secured to the outer covering 18, extending from opposite sides of the covering 18 and traversing the upper surface of the attachment means 12. The strap 62 is preferably of a length that will allow it to be doubled over itself and is adjustable by means of loop and hook fasteners such as Velcro. A pair of adjustment rings 68 secured to the outer covering 18 allow the strap 62 to be tightened and loosened. The user 64, shown in FIG. 7 as a snowboarder, may then insert his hand 66 through the strap 62 and employ this embodiment of the device 60 on one or both hands without the need for a ski pole. However, if the user does wish to use a ski pole, the strap 52 may be adjusted to a length that will allow if to slide loosely about the covering 18 in its expanded state to allow the tip of the pole to be inserted into the attachment means 12. When the strap 62 is thus disposed about the covering 18, it may also be tightened to secure the support base 16 in the closed, or collapsed state for storage and transport (not shown).

Thus, the embodiment shown in FIG. 8 is contemplated both for use on the hand, when the strap 62 is extended over the attachment means 12, as illustrated, or with a ski pole when the strap 62 is loosely disposed about the covering 18, rather than extended over attachment means 12.

Figure 9:
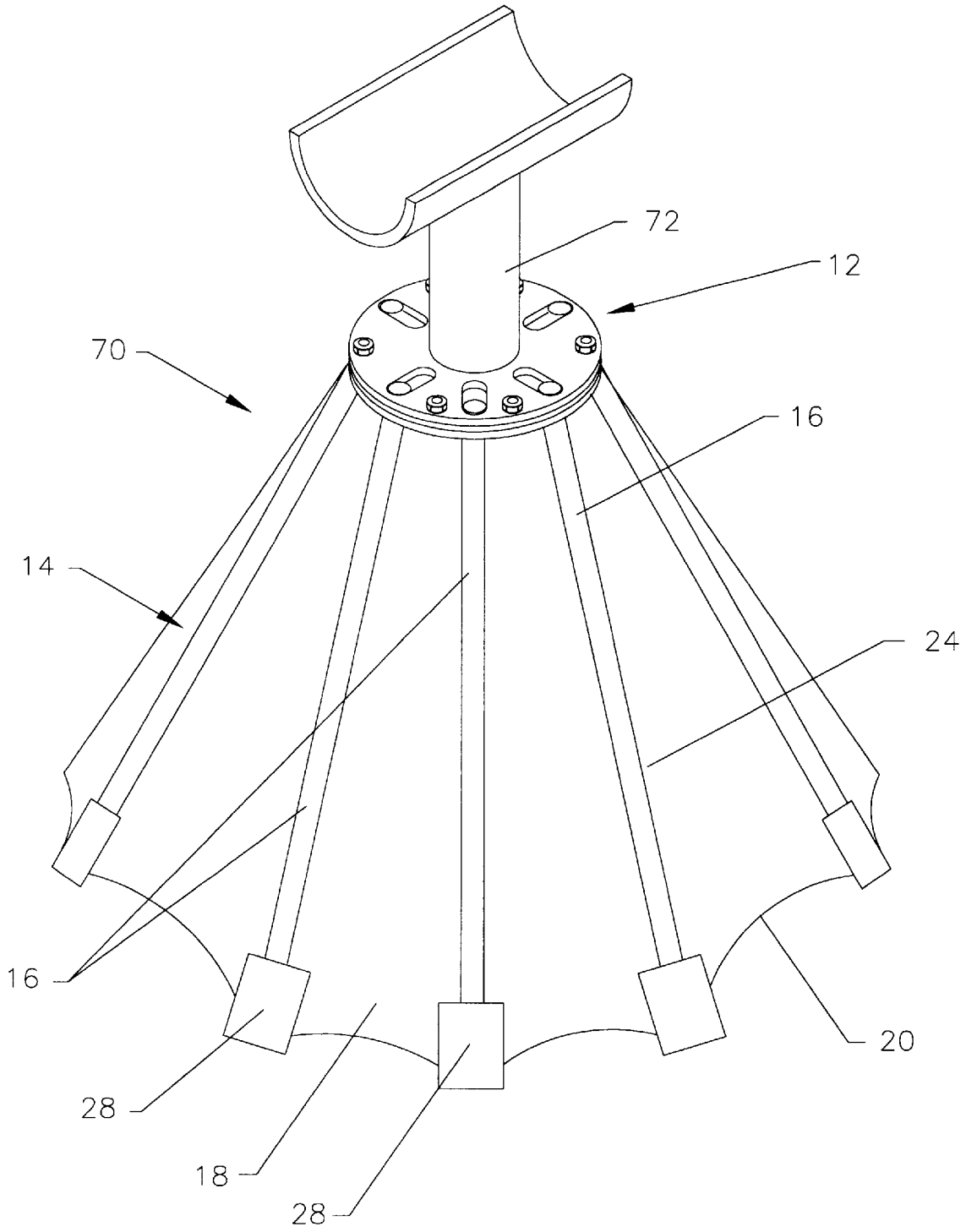
FIG. 9 is a perspective view of a third embodiment of the present invention used as a support stand for equipment.

FIG. 9 illustrates another embodiment of the present invention, where the device 70 is adapted to receive an equipment rack or stand 72, thus serving as an equipment support stand 70 for use on unstable surfaces such as snow or sand. This embodiment 70, like the embodiment 60 shown in FIGS. 7 and 8, is similar in most respects to the device 10 illustrated in FIGS. 1–6, with the exception that it may be preferable to enlarge the components used in the equipment support stand 70 to provide a larger, more sturdy support for use with heavier equipment.

Figure 10:
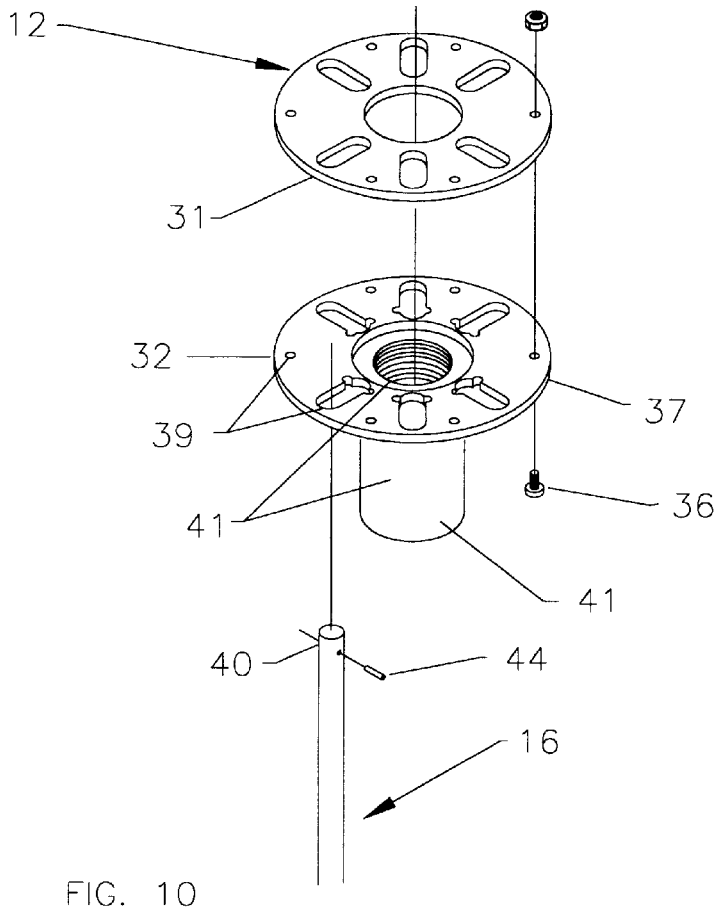
FIG. 10 is an exploded view of the attachment means and support spines employed by the third embodiment of the present invention as a support stand for equipment.
Figure 11A:
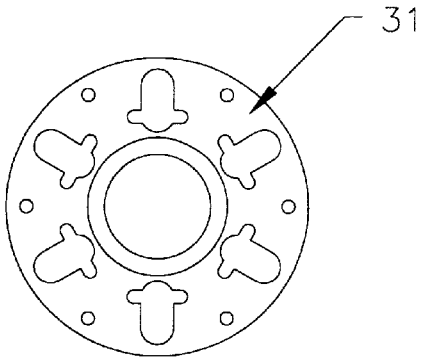
FIG. 11*a* is a top view of the lower portion of the attachment means for use in the third embodiment.
Figure 11B:
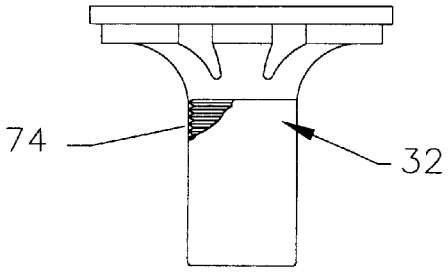
FIG. 11*b* is a cross-sectional view of the lower portion of the attachment means used in the third embodiment, illustrating the threaded cone.

As FIGS. 10, 11*a*, and 11*b* illustrate, the equipment support stand 70 also includes a variation in the attachment means 12, a threaded conical channel 74 in the lower portion 32 to matingly engage a similarly threaded, lower end on the equipment rack or stand 72 to ensure that the equipment stand 72 is securely locked into the support stand 70.

Figure 12:
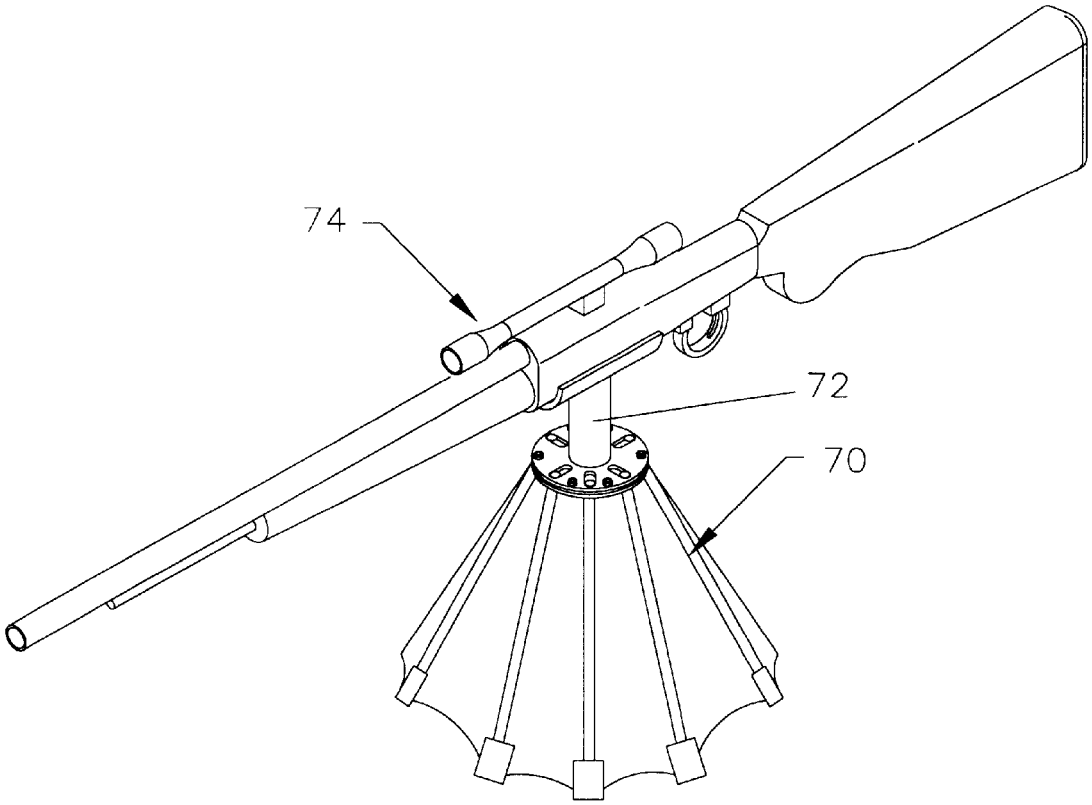
FIG. 12 is a perspective view of the third embodiment of the device used as a support stand for a gun.

Finally, FIG. 12 illustrates the equipment stand 72 secured into the support stand 70 and a shotgun 74 mounted onto the stand 72. This arrangement allows the user of the gun 74 to maintain the gun's stability upon uneven, unstable terrain, such as in snow or sand.

It is therefore to be understood that while the preferred forms of the invention are herein set forth and disclosed, various modifications and changes may be made herein without departing from the spirit and scope of the present invention as defined by the appended claims.

We claim:

1. A weight dispersion and support device for use with a ski pole on an unstable support surface, comprising:

attachment means for fitted engagement with the distal end of said ski pole;

an umbrella-like support base adapted to be opened and closed and having a plurality of support spines pivotally connected to said attachment means and extending outwardly and downwardly therefrom and an outer covering surrounding and supported by said spines, said support base including a support-surface contacting peripheral edge for engagement with said unstable support surface when said device is in the opened state.

2. The device according to claim 1 wherein said attachment means includes upper, lower, and intermediate portions.

3. The device according to claim 2 wherein said upper portion has a generally circular configuration and a central opening therein, said lower portion has a generally, circular upper face and a conical chamber extending outwardly therefrom, and said intermediate portion is a generally circular disk adapted to snugly fit into said central opening of said upper portion, thereby firmly gripping said distal end of said ski pole.

4. The device according to claim 3 wherein said upper and lower portions include a plurality of bores disposed about their respective peripheral edges, said bores arranged for alignment and adapted to receive a plurality of fasteners for securing said upper and lower portions to one another.

5. The device according to claim 1 wherein said outer covering includes a plurality of elongated chambers, each said chamber adapted to receive one of said support spines.

6. The device according to claim 1 wherein said outer covering is made of a substantially flexible and waterproof material.

7. The device according to claim 1 wherein said support-surface contacting peripheral edge has a substantially hexagonal configuration.

8. The device according to claim 1 wherein said support-surface contacting peripheral edge includes an elongated support and tension wire for readily opening and closing said base.

9. The device according to claim 1 wherein said each of said support spines includes opposite longitudinal ends, one of said ends including a bulb adapted for pivotal attachment within aligned bores disposed in said upper and lower portions.

10. The device according to claim 1 further comprising a strap secured to said outer covering and extending over said attachment means, thereby allowing a user of said device to wear the device on a hand.

11. The device according to claim 10 wherein the length of said strap may be adjusted, thereby allowing said strap to extend about said support base when said base is in the closed state, thereby maintaining said support base in said closed state for storage and transport.

12. A weight dispersion and support device for use on an unstable support surface, comprising:

an attachment means including an generally circular upper portion having a plurality of openings therethrough, including a central opening and a plurality of openings arranged about the peripheral edge of said upper portion, a lower portion having a generally circular upper plate having upper and lower surfaces, said upper and lower surfaces including a plurality of openings therethrough aligned with said openings in said upper portion, said lower surface of said upper plate extending downwardly into a conical chamber, said upper and lower portions secured to one another;

a generally umbrella-like support base adapted to be opened and closed and having inner and outer surfaces and a lower support-surface contacting edge for placement upon said support surface when said base is in said opened state, said umbrella-like base including a plurality of elongated support spines, each of said spines having opposite longitudinal ends, one of said ends adapted for pivotal engaged within a pair of said aligned openings, and a flexible, generally circular-shaped outer covering having a plurality of radially extending, elongated chambers therein, each of said chambers adapted to receive and cover one of said support spines, such that when said said device is in the opened state, said support spines extend outwardly from said attachment means at generally obtuse angles.

13. The device according to claim 12 wherein said lower, support-surface contacting edge is circular or hexagonal in configuration.

14. The device according to claim 12 further comprising a flexible strap secured to said outer surface of said umbrella-like support base and having opposite, diametrically disposed longitudinal ends, said strap adjustable for use about the hand of a user or for retaining said device in a closed state.

* * * * *